US010676703B2

(12) United States Patent
Tantawy et al.

(10) Patent No.: US 10,676,703 B2
(45) Date of Patent: Jun. 9, 2020

(54) PROCESS FOR PREPARING A SPRAY-DRIED LAUNDRY DETERGENT PARTICLE

(71) Applicant: The Procter & Gamble Company, Cincinnati, OH (US)

(72) Inventors: Hossam Hassan Tantawy, Northumberland (GB); Jose Rodel Mabilangan Caragay, Newcastle upon Tyne (GB); Eric San Jose Robles, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/723,212

(22) Filed: Oct. 3, 2017

(65) Prior Publication Data

US 2018/0094210 A1 Apr. 5, 2018

(30) Foreign Application Priority Data

| | | |
|---|---|---|
| Oct. 3, 2016 | (EP) | 16192072 |
| Jun. 21, 2017 | (EP) | 17177076 |
| Jun. 21, 2017 | (EP) | 17177087 |

(51) Int. Cl.

| | |
|---|---|
| ***C11D 11/02*** | (2006.01) |
| ***C11D 3/12*** | (2006.01) |
| ***C11D 3/20*** | (2006.01) |
| ***C11D 17/06*** | (2006.01) |
| ***C11D 11/00*** | (2006.01) |
| ***C11D 1/02*** | (2006.01) |
| ***C11D 1/83*** | (2006.01) |
| ***C11D 3/22*** | (2006.01) |
| ***C11D 3/26*** | (2006.01) |
| ***C11D 3/30*** | (2006.01) |
| ***C11D 3/33*** | (2006.01) |
| ***C11D 3/34*** | (2006.01) |
| ***C11D 3/37*** | (2006.01) |
| ***C11D 3/386*** | (2006.01) |
| ***C11D 3/39*** | (2006.01) |
| ***C11D 3/42*** | (2006.01) |
| ***C11D 3/50*** | (2006.01) |
| ***C11D 1/12*** | (2006.01) |
| ***C11D 3/00*** | (2006.01) |
| *C11D 1/24* | (2006.01) |
| *C11D 1/75* | (2006.01) |

(52) U.S. Cl.

CPC ..... *C11D 17/06* (2013.01); *C11D 1/02* (2013.01); *C11D 1/12* (2013.01); *C11D 1/83* (2013.01); *C11D 3/0047* (2013.01); *C11D 3/122* (2013.01); *C11D 3/124* (2013.01); *C11D 3/128* (2013.01); *C11D 3/2075* (2013.01); *C11D 3/2086* (2013.01); *C11D 3/2093* (2013.01); *C11D 3/225* (2013.01); *C11D 3/26* (2013.01); *C11D 3/30* (2013.01); *C11D 3/33* (2013.01); *C11D 3/349* (2013.01); *C11D 3/3418* (2013.01); *C11D 3/3481* (2013.01); *C11D 3/3707* (2013.01); *C11D 3/3715* (2013.01); *C11D 3/3723* (2013.01); *C11D 3/3746* (2013.01); *C11D 3/3757* (2013.01); *C11D 3/38609* (2013.01); *C11D 3/38627* (2013.01); *C11D 3/3942* (2013.01); *C11D 3/42* (2013.01); *C11D 3/50* (2013.01); *C11D 11/0017* (2013.01); *C11D 11/02* (2013.01); *C11D 1/24* (2013.01); *C11D 1/75* (2013.01)

(58) Field of Classification Search

None

See application file for complete search history.

(56) References Cited

U.S. PATENT DOCUMENTS 4,405,483 A * 9/1983 Kuzel ..... C11D 17/0021 252/179
4,707,290 A * 11/1987 Seiter ..... C11D 1/72 510/443
4,988,454 A * 1/1991 Eertink ..... C11D 3/08 510/305

(Continued)

FOREIGN PATENT DOCUMENTS

EP 0137669 A1 * 4/1985
EP 0520582 A1 * 12/1992

(Continued)

OTHER PUBLICATIONS

U.S. Appl. No. 15/723,194, filed Oct. 3, 2017, Chieffi, et al.
U.S. Appl. No. 15/723,195, filed Oct. 3, 2017, Chieffi, et al.
U.S. Appl. No. 15/723,196, filed Oct. 3, 2017, Chieffi, et al.
U.S. Appl. No. 15/723,197, filed Oct. 3, 2017, Chieffi, et al.
U.S. Appl. No. 15/723,214, filed Oct. 3, 2017, Chieffi, et al.
U.S. Appl. No. 15/723,198, filed Oct. 3, 2017, Chieffi, et al.
U.S. Appl. No. 15/723,201, filed Oct. 3, 2017, Chieffi, et al.

(Continued)

*Primary Examiner* — Lorna M Douyon
(74) *Attorney, Agent, or Firm* — Gary J. Foose

(57) ABSTRACT

The present invention relates to a process for preparing a spray-dried laundry detergent particle, wherein the process includes the step of contacting zeolite to monomeric organic carboxylic acid in an aqueous mixture, wherein the aqueous mixture has a pH of 4.2 or less, wherein the aqueous mixture includes detersive surfactant, wherein the aqueous mixture is substantially free of silicate salt, and wherein the aqueous mixture is substantially free of carbonate salt, wherein the zeolite reacts with the monomeric organic carboxylic acid to form silica, wherein the aqueous mixture is spray-dried to form a spray-dried laundry detergent particle, wherein the particle includes: detersive surfactant; monomeric organic carboxylic acid; and silica, wherein the particle is substantially free of silicate salt, and wherein the particle is substantially free of carbonate salt.

13 Claims, No Drawings

(56) References Cited

U.S. PATENT DOCUMENTS

| | | | |
|---|---|---|---|
| 6,162,259 | A | 12/2000 | Williams |
| 2005/0187127 | A1* | 8/2005 | Somerville Roberts ..... C11D 1/12 510/336 |
| 2011/0082066 | A1 | 4/2011 | Wrubbel et al. |
| 2016/0168780 | A1 | 6/2016 | Coggeshall et al. |

FOREIGN PATENT DOCUMENTS

| | | | |
|---|---|---|---|
| EP | 0520582 | A1 | 12/1992 |
| EP | 0574685 | A2 | 12/1993 |
| EP | 0781836 | A1 | 7/1997 |
| EP | 2357220 | A1 | 8/2011 |
| EP | 2363455 | A1 | 9/2011 |
| EP | 2377914 | A1 | 10/2011 |
| EP | 2380957 | A1 | 10/2011 |
| GB | 2106482 | A | 4/1983 |
| WO | WO9117232 | A1 | 11/1991 |
| WO | WO9512658 | A1 | 5/1995 |
| WO | WO9827189 | A1 | 6/1998 |
| WO | 0018856 | A1 | 4/2000 |
| WO | WO0222772 | A1 | 3/2002 |
| WO | 03038028 | A2 | 5/2003 |
| WO | WO2005095572 | A1 | 10/2005 |
| WO | 2006020789 | A1 | 2/2006 |
| WO | 2007057859 | A2 | 5/2007 |
| WO | 2007144857 | A1 | 12/2007 |
| WO | WO2010030540 | A1 | 3/2010 |
| WO | 2011011799 | A2 | 1/2011 |
| WO | 2011133306 | A1 | 10/2011 |
| WO | WO2011134809 | A1 | 11/2011 |
| WO | 2012054835 | A1 | 4/2012 |
| WO | WO2012166768 | A1 | 12/2012 |
| WO | 2013043855 | A2 | 3/2013 |
| WO | WO2013036662 | A1 | 3/2013 |
| WO | 2013184981 | A2 | 12/2013 |
| WO | WO2014190133 | A1 | 11/2014 |
| WO | WO2015169851 | A1 | 11/2015 |
| WO | WO2016124619 | A1 | 8/2016 |

OTHER PUBLICATIONS

U.S. Appl. No. 15/723,202, filed Oct. 3, 2017, Chieffi, et al.
U.S. Appl. No. 15/723,203, filed Oct. 3, 2017, Chieffi, et al.
U.S. Appl. No. 15/723,205, filed Oct. 3, 2017, Chieffi, et al.
U.S. Appl. No. 15/723,207, filed Oct. 3, 2017, Chieffi, et al.
U.S. Appl. No. 15/723,209, filed Oct. 3, 2017, Tantawy, et al.
Extended European Search Report; Application No. 16192053.3-1375; dated Mar. 27, 2017; 19 pages.
Extended European Search Report; Application No. 16192060.8-1375; dated Mar. 29, 2017; 19 pages.
Extended European Search Report; Application No. 17177079.5-1105; dated Feb. 1, 2018; 17 pages.
Extended European Search Report; Application No. 17177087.8-1105; dated Feb. 13, 2018; 13 pages.
Extended European Search Report; Application No. 17194571.0-1358; dated Nov. 20, 2017; 6 pages.
International Search Report; International Application No. PCT/US2017/054813; dated Jan. 9, 2018; 14 pages.
International Search Report; International Application No. PCT/US2017/054814; dated Dec. 20, 2017; 17 pages.
International Search Report; International Application No. PCT/US2017/054815; dated Dec. 13, 2017; 21 pages.
International Search Report; International Application No. PCT/US2017/054816; dated Dec. 13, 2017; 20 pages.
International Search Report; International Application No. PCT/US2017/054817; dated Dec. 21, 2017; 22 pages.
International Search Report; International Application No. PCT/US2017/054819; dated Jan. 5, 2018; 25 pages.
International Search Report; International Application No. PCT/US2017/054821; dated Feb. 7, 2018; 21 pages.
Zinnat, et al.; Remediation of toxic metal contaminated soil by washing with biodegradable aminopolycarboxylate chelants; Chemosphere; vol. 87; No. 10; Jun. 1, 2012; pp. 1161-1170.

* cited by examiner

PROCESS FOR PREPARING A SPRAY-DRIED LAUNDRY DETERGENT PARTICLE

FIELD OF THE INVENTION

The present invention relates to a process for preparing a spray-dried laundry detergent particle. The particles are substantially free of silicate salt and carbonate salt, and have good particle characteristics such as good physical properties, cake strength, flowability as well as good dispensing, dissolution and fabric residue performance (i.e. leave low levels of residue upon laundered fabrics after the laundering process).

BACKGROUND OF THE INVENTION

There is a recent trend in the laundry detergent manufacturing industry to provide laundry detergent powder that, upon dissolution with water, generates a wash liquor having a pH typically in the range of from 7.0 to 9.0. Conventional laundry detergent powders today, upon dissolution with water, provide a wash liquor pH in the range of 10.5-11.0, and sometimes higher. Whilst high a wash pH in these typical ranges provide good cleaning performances, it is difficult to provide fabric care benefits. In seeking to improve the fabric care performance of laundry detergent powder, detergent formulators are developing laundry powder that provides a low pH wash liquor. Typically, this necessitates the removal from the powder of bulk ingredients that provide alkalinity to the wash liquor. Such ingredients are typically carbonate salt such as sodium carbonate, and silicate salt, such as sodium silicate. These ingredients are often formulated into the laundry powder, not only to provide a wash liquour pH of ~10.5, but also to provide good physical properties to the laundry powder.

The base particle of a laundry detergent powder is typically prepared by a spray-drying process. During this process, detergent ingredients such as detersive surfactant, polymer, filler salt if used, are formed into an aqueous mixture, often called a crutcher mix, and then spray-dried to form a spray-dried laundry detergent particle. This spray-dried particle can be used as a laundry detergent powder product, or (and more usually) the spray-dried particle is mixed with other ingredients such as bleach particles, enzyme particles, perfume, and sometimes additional surfactant particles and other dry-added particles like filler particles such as sodium sulphate particles, to form a fully formulated laundry detergent powder.

The presence of carbonate salt and silicate salt in the spray-dried base particle, provide not only the alkalinity typically used by the detergent formulator to provide good cleaning (~10.5), but also provides good physical characteristics to the spray-dried base detergent particle. Such physical characteristics include good cake strength and good flowability.

However, recent moves to formulate laundry detergent powder, and hence also the spray-dried base detergent powder, at a lower pH, has led to the need to remove ingredients such as carbonate salt and silicate salt from the spray-dried base powder. This in turn has led to problems of poor physical properties in the spray-dried particles that are being developed for use in these low pH laundry powder products.

Ingredients such as silica have been considered as a replacement for the carbonate salt and silicate in the spray-dried particle. However, silica is difficult to handle during the manufacturing process. The very low density and small particle size of silica means complicated and elaborate processing equipment and controls will be needed in order to dose silica in a crutcher mix ahead of spray-drying the mixture to form the spray-dried base particle. The behavior of silica during its introduction into the crutcher mixture is often described as gaseous like, or smoke like, and creates many problems such as dusting, and accurate dosing.

The inventors have found that rather than introducing silica as a starting material and trying to dose it into the crutcher mixture, silica can instead be formed in-situ in the crutcher mixture by the reaction of zeolite, which under conditions of low pH forms silica in an aqueous environment. In order to do this, the pH of the crutcher mixture must be carefully controlled so as to cause this reaction to take place.

Zeolite use to be a conventional detergent ingredient that use to be used often in laundry detergent powders. The manufacturing processes and ways of incorporating zeolite into the crutcher mixture are well understood. Zeolite gained popularity as a laundry detergent powder chemistry during the move to nil-phosphate laundry detergent powders a number of decades ago. At that time, zeolite was used as a good replacement for phosphate builder, such as sodium tripolyphosphate (STPP), and the use of zeolite in laundry powder increased. Zeolite is considered to be a good detergent builder. However, over the last decade, the laundry powder manufacturers have moved towards low built laundry detergent powders, and the use of zeolite in laundry powders has significantly decreased.

Instead of re-introducing zeolite into the spray-dried powder, the inventors have found that zeolite can be used as a substrate to form silica in-situ during the spray-drying process. The zeolite converts to silica, and the resultant spray-dried laundry particles are suitable for use not only in low pH laundry powders, but also in low built laundry powder. Since the zeolite converts to silica during the manufacturing process, the resultant particle also has the dispensing, dissolution and good fabric residue performance profiles of a low built laundry detergent powder.

This process provides a means to produce a spray-dried particle that can be used to formulate a low pH laundry powder, that benefits from the presence of silica, such as good physical characteristics, but without having all of the problems associated with trying to dose silica as a starting ingredient directly into the crutcher mixture. In addition, the particles produced by this process also have good dispensing, dissolution and good fabric residue performance profiles.

SUMMARY OF THE INVENTION

The present invention relates to a process for preparing a spray-dried laundry detergent particle, wherein the process comprises the step of contacting zeolite to monomeric organic carboxylic acid in an aqueous mixture, wherein the aqueous mixture has a pH of 4.2 or less, wherein the aqueous mixture comprises detersive surfactant, wherein the aqueous mixture is substantially free of silicate salt, and wherein the aqueous mixture is substantially free of carbonate salt, wherein the zeolite reacts with the monomeric organic carboxylic acid to form silica, wherein the aqueous mixture is spray-dried to form a spray-dried laundry detergent particle, wherein the particle comprises: detersive surfactant; monomeric organic carboxylic acid; and silica, wherein the particle is substantially free of silicate salt, and wherein the particle is substantially free of carbonate salt.

DETAILED DESCRIPTION OF THE INVENTION

Process for preparing a spray-dried laundry detergent particle: The process for preparing a spray-dried laundry detergent particle, comprises the step of contacting zeolite to monomeric organic carboxylic acid in an aqueous mixture, wherein the aqueous mixture has a pH of 4.2 or less, wherein the aqueous mixture comprises detersive surfactant, wherein the aqueous mixture is substantially free of silicate salt, and wherein the aqueous mixture is substantially free of carbonate salt, wherein the zeolite reacts with the monomeric organic carboxylic acid to form silica, wherein the aqueous mixture is spray-dried to form a spray-dried laundry detergent particle, wherein the particle comprises: detersive surfactant; monomeric organic carboxylic acid; and silica, wherein the particle is substantially free of silicate salt, and wherein the particle is substantially free of carbonate salt.

The steps of forming the aqueous mixture, and spray-drying the aqueous mixture are described in more detail below. The spray-drying process can be carried out using any typical spray-drying equipment. Usually, the equipment includes a mixer, typically called a crutcher mixture. It is not uncommon for second mixers or vessels to be used after the first mixer, a common example of this is a drop tank. Typically, pipes are used, often in combination with one or more pumps to transfer the aqueous mixture from the mixer to a nozzle, where the aqueous mixture is then transferred through the nozzle into a spray-drying tower. Often, a first low pressure pump, followed by a second high pressure pump is used to transfer the aqueous mixture through the pipe.

Forming an aqueous mixture: The aqueous mixture is typically formed by contacting detersive surfactant, monomeric organic carboxylic acid, zeolite and water, It is highly preferred for the detersive surfactant to be present when zeolite is contacted with monomeric organic carboxylic acid. The preferred order of addition is to contact detersive surfactant with water, then to contact the monomeric carboxylic acid, and then finally contacting the zeolite. It is essential that the pH of the aqueous mixture be at 4.2 or less for the formation of silica from zeolite to occur. The formation of silica from zeolite is a pH dependent reaction. A pH of 4.2 or less is required for the zeolite to dissolve and form silica. Preferably, the pH of the aqueous mixture is 3.5 or less. The zeolite reacts with the monomeric organic carboxylic acid to form silica. Controlling the weight ratio of monomeric organic carboxylic acid to zeolite is also a preferred feature of the present invention.

The aqueous mixture is substantially free of silicate salt. The aqueous mixture is also substantially free of carbonate salt. By substantially free it is typically meant, no deliberately added. After the formation of silica by controlling the pH of the aqueous mixture, it can be useful to introduce some alkalinity back into the aqueous mixture, depending on the desired pH of the wash liquor the detergent formulator desires. However, bulk alkalinity chemistry such as carbonate salt and/or silicate salt is not to be used. Alkalinity agents such as NaOH are particularly useful in this regard. Typically, the fully formulated laundry detergent powder for which the spray-dried particle can be included, is to be such that upon dissolution with water at 20° C. and at a concentration of 1 g/L in deionsed water, has a pH in the range of from 7.0 to 9.0, preferably from 7.5 to 9.0, or from 7.5 to 8.5. This is considered to be the optimal pH of a low pH laundry detergent powder to provide good fabric care benefits whilst also providing good fabric cleaning performance. The process of the present invention allows the formation of a spray-dried particle having a low pH profile, typically much lower than this optimal pH for the ultimate wash liquor.

Typically, the spray-dried particle has a pH of 6.0 or less, or even 5.0 or less, or 4.2 or less, or even 3.5 or less upon dissolution in de-ionized water at a concentration of 1 g/L and a temperature of 20° C. This pH profile can still be used when formulating a laundry detergent powder, as the spray-dried particle can be combined with other ingredients to raise the pH of the wash liquor back to the ideal pH range described above (e.g. 7.0 to 9.5). For example, the introduction of sodium percarbonate bleach into the laundry powder as a dry-add to be used in combination with the spray-dried base particle is one such alkalinity source. The detergent formulator can take all of this pH effect into account when formulating their desired laundry detergent powder.

Spray-drying the aqueous mixture: Typically, the spray-drying of the aqueous mixture comprises the steps of transferring the aqueous mixture through a pipe leading through a first pump and then through a second pump to a number of spray nozzles. The first pump is typically a low pressure pump, such as a pump that is capable of generating a pressure of from $3\times10^5$ to $1\times10^6$ Pa. Typically, the second pump is a high pressure pump, such as a pump that is capable of generating a pressure of from $2\times10^6$ to $1\times10^7$ Pa. The pressure in the pipe at the outlet of the first pump may be less than $1\times10^6$ Pa. Optionally, the aqueous detergent slurry is transferred through a disintegrator, such as disintegrators supplied by Hosakawa Micron. Typically, disintegrators, is positioned between the pumps. The flow rate of the aqueous detergent slurry along the pipes is typically in the range of from 800 kg/hour to 2,000 kg/hour.

A suitable spray nozzle is a spray systems T4C8 nozzle. Preferably the aqueous detergent slurry is at a temperature of from 60° C. to 130° C. Suitable spray drying towers are concurrent or counter current spray drying towers. Preferably, the inlet air temperature to the spray drying tower is in the range of from 220° C. to 350° C. Preferably, the exhaust air temperature to the spray drying tower is in the range of from 60° C. to 100° C. The spray-dried powder may be subjected to cooling, for example an air lift. Typically, the spray dried powder is subjected to particle size classification to remove oversize material (>1.8 mm) to form a spray dried powder which is free flowing. Fine material (<0.15 mm) is elutriated with the exhaust air in the spray drying tower and collected in a post tower dust containment system.

Aqueous mixture: The aqueous mixture has a pH of 4.2 or less, preferably 3.5 or less. Preferably, the weight ratio of monomeric organic carboxylic acid to zeolite present in the aqueous mixture is at least 1.0, preferably at least 1.2, or even at least 1.2, and most preferably at least 1.6. Having an excess of monomeric organic carboxylic acid to zeolite ensures good reaction kinetics of the formation of silica and also maintains and enables good pH control of the aqueous mixture.

The aqueous mixture, which can also be known as a crutcher mixture, can also contain other detergent ingredients that are suitable for inclusion into the spray-dried laundry detergent particle. Suitable ingredients are described in more detail below, but include polymers, chelants, hueing dyes, brighteners, colouants and pigments. Preferably, the aqueous mixture comprises carboxylate polymer.

A preferred chemical composition of the aqueous mixture, after the zeolite has reacted with the monomeric organic carboxylic acid, is such that the aqueous mixture comprises: (a) from 20 wt % to 40 wt % water; (b) from 7.2 wt % to 24 wt % detersive surfactant; (c) from 2.4 wt % to 8 wt % monomeric organic carboxylic acid; (d) from 0.3 wt % to 2.4 wt % silica; (e) optionally, from 1.2 wt % to 8 wt % magnesium sulphate; (f) optionally, from 0.3 wt % to 4 wt % polymer; and (g) optionally, from 21 wt % to 64 wt % sodium sulphate.

Spray-dried laundry detergent particle: The particle comprises: detersive surfactant; monomeric organic carboxylic acid; and silica. The particle is substantially free of silicate salt, and the particle is substantially free of carbonate salt. Other ingredients can be included in the particle, these ingredients are described in more detail below. Preferably, the particle comprises: (a) from 12 wt % to 30 wt % detersive surfactant; (b) from 4 wt % to 10 wt % monomeric organic carboxylic acid; (c) from 0.5 wt % to 3 wt % silica; (d) optionally, from 2 wt % to 10 wt % magnesium sulphate; (e) optionally, from 0.5 wt % to 5 wt % polymer; (f) optionally, from 35 wt % to 80 wt % sodium sulphate; and (g) optionally, from 0 wt % to 6 wt % water.

As mentioned above, the particle may have a pH of 6.0 or less, or 5.0 or less, or 4.2 or less, or 3.5 or less upon dissolution in de-ionized water at a concentration of 10 wt % and a temperature of 25° C. The particle may comprise alkalinity agents, a preferred alkalinity agent is NaOH.

The particle may comprises magnesium sulphate, preferably the particle comprises magnesium sulphate in amorphous form.

Monomeric organic carboxylic acid: The monomeric organic carboxylic acid is preferably a monomeric organic polycarboxylic acid, most preferably citric acid. Other suitable acids include:

formic acid, acetic acid, propionic acid, butyric acid, caprylic acid and lauric Acid, stearic acid, linoleic acid and acrylic acid, methacrylic acid, chloroacetic acid and citric acid, lactic acid, glyoxylic acid, acetoacetic acid, oxalic acid, malonic acid, adipic acid and phenylacetic acid, benzoic acid, salicylic acid, glycine and alanine, valine, aspartic acid, glutamic acid, lysine and phenylalanine, nicotinic acid, picolinic acid, fumaric acid, lactic acid, benzoic acid, glutamic acid; succinic acid, glycolic acid. Preferably, the organic acid is selected from the group citric acid, malic acid, succinic acid, lactic acid, glycolic acid, fumaric acid, tartaric acid, and formic acids and mixtures thereof. More preferably, the acid is citric acid, lactic acid and tartaric acid.

Zeolites: Suitable zeolites include type 4 A zeolite, which typically have silicon to aluminium ratio of 1.0. Without wishing to be bound by theory, the inventors believe that this specific ratio and its resulting structure allows the acid to access the aluminium molecules which completely deionizes at a certain pH. Given the aluminium is well distributed in between the silicon molecules, the complete deionization of aluminium molecules necessitates the breakdown of the silicon molecules which later forms as monosilicic acid that eventually precipitate as polymerized silica. Other types of zeolite that undergo dissolution of aluminium ions are also suitable, however, the silicon molecules may only undergo partial dissolution. It is the breakdown of the aluminium ions that allow the silicon ions to eventually dissolve. The relative location of the aluminium to the silicon molecule may therefore important and this is dictated by its ratio. Zeolites having a silicon to aluminium ratio of from 1.0 to less than 3.0, and from 1.0 to 1.6, or from 1.0 to 1.2 are also suitable.

Detersive surfactant: A preferred detersive surfactant is alkyl benzene sulphonate. Suitable detersive surfactants include anionic detersive surfactants, non-ionic detersive surfactant, cationic detersive surfactants, zwitterionic detersive surfactants and amphoteric detersive surfactants. Suitable detersive surfactants may be linear or branched, substituted or un-substituted, and may be derived from petrochemical material or biomaterial.

Anionic detersive surfactant: Suitable anionic detersive surfactants include sulphonate and sulphate detersive surfactants.

Suitable sulphonate detersive surfactants include methyl ester sulphonates, alpha olefin sulphonates, alkyl benzene sulphonates, especially alkyl benzene sulphonates, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, other suitable LAB include high 2-phenyl LAB, such as those supplied by Sasol under the tradename Hyblene®.

Suitable sulphate detersive surfactants include alkyl sulphate, preferably $C_{8-18}$ alkyl sulphate, or predominantly $C_{12}$ alkyl sulphate.

A preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 5, more preferably from 0.5 to 3 and most preferably from 0.5 to 1.5.

The alkyl sulphate, alkyl alkoxylated sulphate and alkyl benzene sulphonates may be linear or branched, substituted or un-substituted, and may be derived from petrochemical material or biomaterial.

Other suitable anionic detersive surfactants include alkyl ether carboxylates.

Suitable anionic detersive surfactants may be in salt form, suitable counter-ions include sodium, calcium, magnesium, amino alcohols, and any combination thereof. A preferred counter-ion is sodium.

Non-ionic detersive surfactant: Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; alkylpolysaccharides, preferably alkylpolyglycosides; methyl ester ethoxylates; polyhydroxy fatty acid amides; ether capped poly(oxyalkylated) alcohol surfactants; and mixtures thereof.

Suitable non-ionic detersive surfactants are alkylpolyglucoside and/or an alkyl alkoxylated alcohol.

Suitable non-ionic detersive surfactants include alkyl alkoxylated alcohols, preferably $C_{8-18}$ alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. The alkyl alkoxylated alcohol can be linear or branched, and substituted or un-substituted.

Suitable nonionic detersive surfactants include secondary alcohol-based detersive surfactants.

Cationic detersive surfactant: Suitable cationic detersive surfactants include alkyl pyridinium compounds, alkyl quaternary ammonium compounds, alkyl quaternary phosphonium compounds, alkyl ternary sulphonium compounds, and mixtures thereof.

Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate.

Zwitterionic detersive surfactant: Suitable zwitterionic detersive surfactants include amine oxides and/or betaines.

Carboxylate polymer: A suitable carboxylate polymer includes polymers such as a maleate/acrylate random copolymer or polyacrylate homopolymer. Suitable carboxylate polymers include: polyacrylate homopolymers having a molecular weight of from 4,000 Da to 9,000 Da; maleate/acrylate random copolymers having a molecular weight of from 30,000 Da to 100,000 Da, or from 50,000 Da to 100,000 Da, or from 60,000 Da to 80,000 Da.

Another suitable carboxylate polymer is a co-polymer that comprises: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

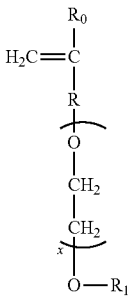

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

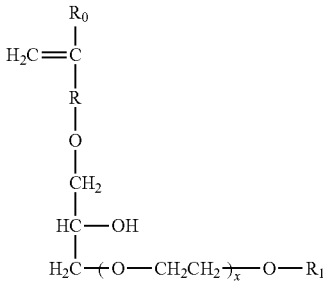

wherein in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

It may be preferred that the polymer has a weight average molecular weight of at least 30 kDa, or at least 50 kDa, or even at least 70 kDa.

Product obtainable by the process of the present invention: The product obtainable by a process according to the present invention has different product characteristics due to it process of manufacture. The product has good physical properties, such as good cake strength and good flowability. The product also has good dispensing, dissolution of fabric residue performance. This is due to the in-situ formation of silica, compared to the addition of silica as a starting material into the crutcher mixture.

Solid free-flowing particulate laundry detergent composition: Typically, the spray-dried particle prepared by the process of the present invention can be combined with other particles to form a solid free-flowing particulate laundry detergent composition that is a fully formulated laundry detergent powder composition. Typically, the solid composition comprises a plurality of chemically different particles, such as the spray-dried base detergent particle in combination with one or more agglomerated detergent particles and/or extruded detergent particles. The spray-dried particle may be used in combination with one or more, typically two or more, or five or more, or even ten or more particles selected from: surfactant particles, including surfactant agglomerates, surfactant extrudates, surfactant needles, surfactant noodles, surfactant flakes; phosphate particles; zeolite particles; polymer particles such as carboxylate polymer particles, cellulosic polymer particles, starch particles, polyester particles, polyamine particles, terephthalate polymer particles, polyethylene glycol particles; aesthetic particles such as coloured noodles, needles, lamellae particles and ring particles; enzyme particles such as protease granulates, amylase granulates, lipase granulates, cellulase granulates, mannanase granulates, pectate lyase granulates, xyloglucanase granulates, bleaching enzyme granulates and co-granulates of any of these enzymes, preferably these enzyme granulates comprise sodium sulphate; bleach particles, such as percarbonate particles, especially coated percarbonate particles, such as percarbonate coated with carbonate salt, sulphate salt, silicate salt, borosilicate salt, or any combination thereof, perborate particles, bleach activator particles such as tetra acetyl ethylene diamine particles and/or alkyl oxybenzene sulphonate particles, bleach catalyst particles such as transition metal catalyst particles, and/or isoquinolinium bleach catalyst particles, pre-formed peracid particles, especially coated pre-formed peracid particles; filler particles such as sulphate salt particles and chloride particles; clay particles such as montmorillonite particles and particles of clay and silicone; flocculant particles such as polyethylene oxide particles; wax particles such as wax agglomerates; silicone particles, brightener particles; dye transfer inhibition particles; dye fixative particles; perfume particles such as perfume microcapsules and starch encapsulated perfume accord particles, or pro-perfume particles such as Schiff base reaction product particles; hueing dye particles; chelant particles such as chelant agglomerates; and any combination thereof.

The composition may comprise: silicate salt particles, especially sodium silicate particles; and/or carbonate salt particles, especially sodium bicarbonate particles. However it may be preferred for the composition to be free of silicate salt particles, especially free of sodium silicate particles. It may also be preferred for the composition to be free of carbonate salt particles, especially free of sodium carbonate particles.

Preferably, the composition comprises from 1 wt % to 10 wt % dry-added acid particles, preferably from 2 wt % to 8 wt % dry-added acid particles. A suitable dry-added acid is an organic acid, preferably a carboxylic acid, preferably cirtric acid.

Detergent Ingredients: Suitable laundry detergent compositions comprise a detergent ingredient selected from: detersive surfactant, such as anionic detersive surfactants, nonionic detersive surfactants, cationic detersive surfactants, zwitterionic detersive surfactants and amphoteric detersive surfactants; polymers, such as carboxylate polymers, soil release polymer, anti-redeposition polymers, cellulosic polymers and care polymers; bleach, such as sources of hydrogen peroxide, bleach activators, bleach catalysts and pre-formed peracids; photobleach, such as such as zinc and/or aluminium sulphonated phthalocyanine; enzymes, such as proteases, amylases, cellulases, lipases; zeolite builder; phosphate builder; co-builders, such as citric acid and citrate; sulphate salt, such as sodium sulphate; chloride salt, such as sodium chloride; brighteners; chelants; hueing agents; dye transfer inhibitors; dye fixative agents; perfume; silicone; fabric softening agents, such as clay; flocculants, such as polyethyleneoxide; suds supressors; and any combination thereof.

The composition may comprise: silicate salt, especially sodium silicate; and/or carbonate salt, especially sodium bicarbonate and/or sodium carbonate. However it may be preferred for the composition to be free of silicate salt, especially free of sodium silicate. It may also be preferred for the composition to be free of carbonate salt, especially free of sodium carbonate and/or sodium bicarbonate.

The composition may have a pH profile such that upon dilution in de-ionized water at a concentration of 1 g/L at a temperature of 20° C., the composition has a pH in the range of from 7.0 to 9.0, preferably from 7.0 to 8.5, or even from 7.5 to 8.5.

Suitable laundry detergent compositions may have a low buffering capacity. Such laundry detergent compositions typically have a reserve alkalinity to pH 7.5 of less than 5.0 g NaOH/100 g, preferably less than 3.0 g NaOH/100 g.

The composition is preferably substantially free of preformed peracid. The composition is preferably substantially free of phthalimido-peroxycaproic acid. Substantially free means no deliberately added.

Detersive Surfactant: Suitable detersive surfactants are described above.

Polymer: Suitable polymers include carboxylate polymers, soil release polymers, anti-redeposition polymers, cellulosic polymers, care polymers and any combination thereof.

Carboxylate polymer: Suitable carboxylate polymers are described above.

Soil release polymer: The composition may comprise a soil release polymer. A suitable soil release polymer has a structure as defined by one of the following structures (I), (II) or (III):

$$—[(OCHR^1—CHR^2)_a—O—OC—Ar—CO—]_d$$

$$—[(OCHR^3—CHR^4)_b—O—OC\text{-}sAr—CO—]_e$$

$$—[(OCHR^5—CHR^6)_c—OR^7]_f$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are sold by Clariant under the TexCare® series of polymers, e.g. TexCare® SRN240 and TexCare® SRA300. Other suitable soil release polymers are sold by Solvay under the Repel-o-Tex® series of polymers, e.g. Repel-o-Tex® SF2 and Repel-o-Tex® Crystal.

Anti-redeposition polymer: Suitable anti-redeposition polymers include polyethylene glycol polymers and/or polyethyleneimine polymers.

Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4. A suitable polyethylene glycol polymer is Sokalan HP22. Suitable polyethylene glycol polymers are described in WO08/007320.

Cellulosic polymer: Suitable cellulosic polymers are selected from alkyl cellulose, alkyl alkoxyalkyl cellulose, carboxyalkyl cellulose, alkyl carboxyalkyl cellulose, sulphoalkyl cellulose, more preferably selected from carboxymethyl cellulose, methyl cellulose, methyl hydroxyethyl cellulose, methyl carboxymethyl cellulose, and mixtures thereof.

Suitable carboxymethyl celluloses have a degree of carboxymethyl substitution from 0.5 to 0.9 and a molecular weight from 100,000 Da to 300,000 Da.

Suitable carboxymethyl celluloses have a degree of substitution greater than 0.65 and a degree of blockiness greater than 0.45, e.g. as described in WO09/154933.

Care polymers: Suitable care polymers include cellulosic polymers that are cationically modified or hydrophobically modified. Such modified cellulosic polymers can provide anti-abrasion benefits and dye lock benefits to fabric during the laundering cycle. Suitable cellulosic polymers include cationically modified hydroxyethyl cellulose.

Other suitable care polymers include dye lock polymers, for example the condensation oligomer produced by the condensation of imidazole and epichlorhydrin, preferably in ratio of 1:4:1. A suitable commercially available dye lock polymer is Polyquart® FDI (Cognis).

Other suitable care polymers include amino-silicone, which can provide fabric feel benefits and fabric shape retention benefits.

Bleach: Suitable bleach includes sources of hydrogen peroxide, bleach activators, bleach catalysts, pre-formed peracids and any combination thereof. A particularly suitable bleach includes a combination of a source of hydrogen peroxide with a bleach activator and/or a bleach catalyst.

Source of hydrogen peroxide: Suitable sources of hydrogen peroxide include sodium perborate and/or sodium percarbonate.

Bleach activator: Suitable bleach activators include tetra acetyl ethylene diamine and/or alkyl oxybenzene sulphonate.

Bleach catalyst: The composition may comprise a bleach catalyst. Suitable bleach catalysts include oxaziridinium bleach catalysts, transition metal bleach catalysts, especially manganese and iron bleach catalysts. A suitable bleach catalyst has a structure corresponding to general formula below:

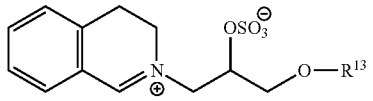

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl.

Pre-formed peracid: Suitable pre-form peracids include phthalimido-peroxycaproic acid.

Enzymes: Suitable enzymes include lipases, proteases, cellulases, amylases and any combination thereof.

Protease: Suitable proteases include metalloproteases and/or serine proteases. Examples of suitable neutral or alkaline proteases include: subtilisins (EC 3.4.21.62); trypsin-type or chymotrypsin-type proteases; and metalloproteases. The suitable proteases include chemically or genetically modified mutants of the aforementioned suitable proteases.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Preferenz P® series of proteases including Preferenz® P280, Preferenz® P281, Preferenz® P2018-C, Preferenz® P2081-WE, Preferenz® P2082-EE and Preferenz® P2083-A/J, Properase®, Purafect®, Purafect Prime®, Purafect Ox®, FN3®, FN4®, Excellase® and Purafect OXP® by DuPont, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

A suitable protease is described in WO11/140316 and WO11/072117.

Amylase: Suitable amylases are derived from AA560 alpha amylase endogenous to *Bacillus* sp. DSM 12649, preferably having the following mutations: R118K, D183*, G184*, N195F, R320K, and/or R458K. Suitable commercially available amylases include Stainzyme®, Stainzyme® Plus, Natalase, Termamyl®, Termamyl® Ultra, Liquezyme® SZ, Duramyl®, Everest® (all Novozymes) and Spezyme® AA, Preferenz S® series of amylases, Purastar® and Purastar® Ox Am, Optisize® HT Plus (all Du Pont).

A suitable amylase is described in WO06/002643.

Cellulase: Suitable cellulases include those of bacterial or fungal origin. Chemically modified or protein engineered mutants are also suitable. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum.*

Commercially available cellulases include Celluzyme®, Carezyme®, and Carezyme® Premium, Celluclean® and Whitezyme® (Novozymes A/S), Revitalenz® series of enzymes (Du Pont), and Biotouch® series of enzymes (AB Enzymes). Suitable commercially available cellulases include Carezyme® Premium, Celluclean® Classic. Suitable cellulases are described in WO07/144857 and WO10/056652.

Lipase: Suitable lipases include those of bacterial, fungal or synthetic origin, and variants thereof. Chemically modified or protein engineered mutants are also suitable. Examples of suitable lipases include lipases from *Humicola* (synonym *Thermomyces*), e.g., from *H. lanuginosa* (*T. lanuginosus*).

The lipase may be a "first cycle lipase", e.g. such as those described in WO06/090335 and WO13/116261. In one aspect, the lipase is a first-wash lipase, preferably a variant of the wild-type lipase from *Thermomyces lanuginosus* comprising T231R and/or N233R mutations. Preferred lipases include those sold under the tradenames Lipex®, Lipolex® and Lipoclean® by Novozymes, Bagsvaerd, Denmark.

Other suitable lipases include: Liprl 139, e.g. as described in WO2013/171241; and TfuLip2, e.g. as described in WO2011/084412 and WO2013/033318.

Other enzymes: Other suitable enzymes are bleaching enzymes, such as peroxidases/oxidases, which include those of plant, bacterial or fungal origin and variants thereof. Commercially available peroxidases include Guardzyme®

(Novozymes A/S). Other suitable enzymes include choline oxidases and perhydrolases such as those used in Gentle Power Bleach™.

Other suitable enzymes include pectate lyases sold under the tradenames X-Pect®, Pectaway® (from Novozymes A/S, Bagsvaerd, Denmark) and PrimaGreen® (DuPont) and mannanases sold under the tradenames Mannaway® (Novozymes A/S, Bagsvaerd, Denmark), and Mannastar® (Du Pont).

Zeolite builder: The composition may comprise zeolite builder. The composition may comprise from 0 wt % to 5 wt % zeolite builder, or 3 wt % zeolite builder. The composition may even be substantially free of zeolite builder; substantially free means "no deliberately added". Typical zeolite builders include zeolite A, zeolite P and zeolite MAP.

Phosphate builder: The composition may comprise phosphate builder. The composition may comprise from 0 wt % to 5 wt % phosphate builder, or to 3 wt %, phosphate builder. The composition may even be substantially free of phosphate builder; substantially free means "no deliberately added". A typical phosphate builder is sodium tri-polyphosphate.

Carbonate salt: The composition may comprise carbonate salt. The composition may comprise from 0 wt % to 5 wt % carbonate salt. The composition may even be substantially free of carbonate salt; substantially free means "no deliberately added". Suitable carbonate salts include sodium carbonate and sodium bicarbonate.

Silicate salt: The composition may comprise silicate salt. The composition may comprise from 0 wt % to 5 wt % silicate salt. The composition may even be substantially free of silicate salt; substantially free means "no deliberately added". A preferred silicate salt is sodium silicate, especially preferred are sodium silicates having a $Na_2O:SiO_2$ ratio of from 1.0 to 2.8, preferably from 1.6 to 2.0.

Sulphate salt: A suitable sulphate salt is sodium sulphate.

Brightener: Suitable fluorescent brighteners include: distyryl biphenyl compounds, e.g. Tinopal® CBS-X, di-amino stilbene di-sulfonic acid compounds, e.g. Tinopal® DMS pure Xtra and Blankophor® HRH, and Pyrazoline compounds, e.g. Blankophor® SN, and coumarin compounds, e.g. Tinopal® SWN.

Preferred brighteners are: sodium 2 (4-styryl-3-sulfophenyl)-2H-napthol[1,2-d]triazole, disodium 4,4'-bis{[(4-anilino-6-(N methyl-N-2 hydroxyethyl)amino 1,3,5-triazin-2-yl)]amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis(2-sulfostyryl)biphenyl. A suitable fluorescent brightener is C.I. Fluorescent Brightener 260, which may be used in its beta or alpha crystalline forms, or a mixture of these forms.

Chelant: The composition may also comprise a chelant selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). A preferred chelant is ethylene diamine-N'N'-disuccinic acid (EDDS) and/or hydroxyethane diphosphonic acid (HEDP). The composition preferably comprises ethylene diamine-N'N'-disuccinic acid or salt thereof. Preferably the ethylene diamine-N'N'-disuccinic acid is in S,S enantiomeric form. Preferably the composition comprises 4,5-dihydroxy-m-benzenedisulfonic acid disodium salt. Preferred chelants may also function as calcium carbonate crystal growth inhibitors such as: 1-hydroxyethanediphosphonic acid (HEDP) and salt thereof; N,N-dicarboxymethyl-2-aminopentane-1,5-dioic acid and salt thereof; 2-phosphonobutane-1,2,4-tricarboxylic acid and salt thereof; and combination thereof.

Hueing agent: Suitable hueing agents include small molecule dyes, typically falling into the Colour Index (C.I.) classifications of Acid, Direct, Basic, Reactive (including hydrolysed forms thereof) or Solvent or Disperse dyes, for example classified as Blue, Violet, Red, Green or Black, and provide the desired shade either alone or in combination. Preferred such hueing agents include Acid Violet 50, Direct Violet 9, 66 and 99, Solvent Violet 13 and any combination thereof.

Many hueing agents are known and described in the art which may be suitable for the present invention, such as hueing agents described in WO2014/089386.

Suitable hueing agents include phthalocyanine and azo dye conjugates, such as described in WO2009/069077.

Suitable hueing agents may be alkoxylated. Such alkoxylated compounds may be produced by organic synthesis that may produce a mixture of molecules having different degrees of alkoxylation. Such mixtures may be used directly to provide the hueing agent, or may undergo a purification step to increase the proportion of the target molecule. Suitable hueing agents include alkoxylated bis-azo dyes, such as described in WO2012/054835, and/or alkoxylated thiophene azo dyes, such as described in WO2008/087497 and WO2012/166768.

The hueing agent may be incorporated into the detergent composition as part of a reaction mixture which is the result of the organic synthesis for a dye molecule, with optional purification step(s). Such reaction mixtures generally comprise the dye molecule itself and in addition may comprise un-reacted starting materials and/or by-products of the organic synthesis route. Suitable hueing agents can be incorporated into hueing dye particles, such as described in WO 2009/069077.

Dye transfer inhibitors: Suitable dye transfer inhibitors include polyamine N-oxide polymers, copolymers of N-vinylpyrrolidone and N-vinylimidazole, polyvinylpyrrolidone, polyvinyloxazolidone, polyvinylimidazole and mixtures thereof. Preferred are poly(vinyl pyrrolidone), poly (vinylpyridine betaine), poly(vinylpyridine N-oxide), poly (vinyl pyrrolidone-vinyl imidazole) and mixtures thereof. Suitable commercially available dye transfer inhibitors include PVP-K15 and K30 (Ashland), Sokalan® HP165, HP50, HP53, HP59, HP56K, HP56, HP66 (BASF), Chromabond® S-400, S403E and S-100 (Ashland).

Perfume: Suitable perfumes comprise perfume materials selected from the group: (a) perfume materials having a C log P of less than 3.0 and a boiling point of less than 250° C. (quadrant 1 perfume materials); (b) perfume materials having a C log P of less than 3.0 and a boiling point of 250° C. or greater (quadrant 2 perfume materials); (c) perfume materials having a C log P of 3.0 or greater and a boiling point of less than 250° C. (quadrant 3 perfume materials); (d) perfume materials having a C log P of 3.0 or greater and a boiling point of 250° C. or greater (quadrant 4 perfume materials); and (e) mixtures thereof.

It may be preferred for the perfume to be in the form of a perfume delivery technology. Such delivery technologies further stabilize and enhance the deposition and release of perfume materials from the laundered fabric. Such perfume delivery technologies can also be used to further increase the longevity of perfume release from the laundered fabric. Suitable perfume delivery technologies include: perfume microcapsules, pro-perfumes, polymer assisted deliveries, molecule assisted deliveries, fiber assisted deliveries, amine assisted deliveries, cyclodextrin, starch encapsulated accord, zeolite and other inorganic carriers, and any mixture thereof. A suitable perfume microcapsule is described in WO2009/101593.

Silicone: Suitable silicones include polydimethylsiloxane and amino-silicones. Suitable silicones are described in WO05075616.

EXAMPLES

Process of Making a Spray Dried Granule Compositions—Impact of Slurry pH on Processing and Powder Quality:

The aqueous detergent slurry A was prepared by first adding water into in a slurry making vessel (crutcher). The crutcher was then set to a sufficient agitation while the rest of the ingredients were added one after the other using the following sequence of addition:

1. LAS paste
2. Citric acid
3. Acrylic-Maleic Polymer Salt
4. Aluminosilicate builder, Type 4A
5. Magnesium sulphate
6. Sodium sulphate LAS paste which has a pH of 9 to 11.5, was added to the water that was sufficiently agitated in the crutcher. Citric acid was added next, followed by the polymer then the zeolite. Zeolite was added to the acidic mix, ensuring its proper dispersion to enable its dissolution. The resulting mixture at this point must have a pH less than 4.2. In this acidic environment, zeolite was dealuminated followed by the breakdown of silicon which later would eventually precipitate as an amorphous silica. The slurry was mixed until sufficient dispersion of the all the ingredients was achieved with an end pH of 3.5, measured as a 10% solution using deionized water at 25 C. An end of batch slurry temperature of 85° C. was achieved by using direct steam injection (saturated steam at a pressure of $6.0\times10^5$ Pa) to the crutcher. The slurry mix was transferred to a larger mixing vessel before it's pumped and atomized to the spray drying tower.

The aqueous detergent slurry B was prepared by first adding the caustic solution to the water in a sufficiently agitated crutcher. The rest of the materials are added following the same sequence of addition used in preparing the aqueous detergent slurry A. In this mixture, the slurry pH was considerably higher than for slurry A throughout the mixing process to ensure the zeolite remained in its crystalline form.

| | | All amounts of ingredients given below are in weight % | | | |
|---|---|---|---|---|---|
| | | (A - invention) Aqueous slurry (weight parts) | | (B - comparative) Aqueous slurry (weight parts) | |
| — | — | Before | After | | |
| Component — | Activity — | Zeolite dissolution | Zeolite Dissolution | Before Neutralization | After Neutralization |
| LAS | 45% wt aq | 31.0675 | 31.0675 | 31.4001 | 31.4001 |
| Citric Acid | 100 wt % anhydrous | 4.7796 | 4.7796 | 4.8308 | NA |
| Trisodium citrate | | NA | NA | NA | 6.4917 |
| Acrylic-Maleic Polymer Salt | 40% wt aq | 2.6885 | 2.6885 | 2.7173 | 2.7173 |
| Magnesium Sulphate | 100 wt % anhydrous | 2.9629 | 2.9629 | 2.9946 | 2.9946 |
| Aluminosilicate builder | 80 wt % powder | 2.7226 | NA | 2.7517 | 2.7517 |
| Amorphous Silica | 100 wt % anhydrous | NA | 0.7161 | NA | NA |
| Misc | 100 wt % anhydrous | NA | 1.4620 | NA | NA |
| Sodium sulphate | 100 wt % anhydrous | 44.4112 | 44.4112 | 40.7582 | 40.7582 |
| Sodium Hydroxide | 50% wt aq | NA | NA | 6.2305 | NA |
| Water | | 11.3676 | 11.9121 | 8.3167 | 12.8864 |
| Aqueous slurry parts | | 100.000 | 100.000 | 100.000 | 100.0000 |

The atomized slurries were dried, cooled and sieved to remove oversize material (>1.8 mm) to form a spray-dried powders. Fine material (<0.15 mm) was elutriated with the exhaust the exhaust air in the spray-drying tower and collected in a post tower containment system. The spray-dried powders were dried to a moisture content of 2 wt percent.

Spray-Dried Powder:

| | | All amounts of ingredients given below are in weight % | |
|---|---|---|---|
| Ingredients | | (A - invention) Low pH | (B - comparative) High pH |
| LAS | 100 wt % anhydrous | 19.5000 | 19.5000 |
| Citric Acid | 100 wt % anhydrous | 6.6667 | — |
| Trisodium Citrate | 100 wt % anhydrous | — | 8.9588 |
| Acrylic-Maleic Polymer Salt | 100 wt % anhydrous | 1.5000 | 1.5000 |

-continued

| Ingredients | | All amounts of ingredients given below are in weight % (A - invention) Low pH | (B - comparative) High pH |
|---|---|---|---|
| Magnesium Sulphate | 100 wt % anhydrous | 4.0500 | 4.0500 |
| Aluminosilicate builder (Zeolite) | 100 wt % anhydrous | — | 3.000 |
| Amorphous Silica | 100 wt % anhydrous | 0.9863 | — |
| Sodium sulphate | 100 wt % anhydrous | 64.202 | 60.9948 |
| Miscellaneous | | 1.095 | — |
| Water | — | 2.0000 | 2.0000 |
| Total Parts | | 100.0000 | 100.0000 |

The pH and the cake strength of the spray dried powders were then measured according to the method described below. The cake strength in comparative case B has an unacceptably high cake strength. One case A representing the invention has an acceptable low cake strength.

| Measures | Units | (A - invention) Low pH | (B - comparative) High pH |
|---|---|---|---|
| Cake Strength | Kg f | 1.25 | 3.27 |
| pH, 10% Solution @ 25 C. | | 3.63 | 8.61 |

Method for Measuring Cake Strength:

A smooth plastic cylinder of internal diameter 6.35 cm and length 15.9 cm is supported on a suitable base plate. A 0.65 cm hole is drilled through the cylinder with the centre of the hole being 9.2 cm from the end opposite the base plate.

A metal pin is inserted through the hole and a smooth plastic sleeve of internal diameter 6.35 cm and length 15.25 cm is placed around the inner cylinder such that the sleeve can move freely up and down the cylinder and comes to rest on the metal pin. The space inside the sleeve is then filled (without tapping or excessive vibration) with the spray-dried powder such that the spray-dried powder is level with the top of the sleeve. A lid is placed on top of the sleeve and a 5 kg weight placed on the lid. The pin is then pulled out and the spray-dried powder is allowed to compact for 2 minutes. After 2 minutes the weight is removed, the sleeve is lowered to expose the powder cake with the lid remaining on top of the powder.

A metal probe is then lowered at 54 cm/min such that it contacts the centre of the lid and breaks the cake. The maximum force required to break the cake is recorded and is the result of the test. A cake strength of 0 N refers to the situation where no cake is formed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for preparing a spray-dried laundry detergent particle, wherein the process comprises the step of contacting zeolite to monomeric organic carboxylic acid in an aqueous mixture, wherein the aqueous mixture has a pH of 4.2 or less, wherein the aqueous mixture comprises detersive surfactant, wherein the aqueous mixture is substantially free of silicate salt, and wherein the aqueous mixture is substantially free of carbonate salt, wherein the zeolite reacts with the monomeric organic carboxylic acid to form silica, wherein after the zeolite has reacted with the monomeric organic carboxylic acid, the aqueous mixture comprises from about 7.2 wt % to about 24 wt % detersive surfactant, wherein the aqueous mixture is spray-dried to form a spray-dried laundry detergent particle, wherein the particle comprises: detersive surfactant; monomeric organic carboxylic acid; and silica, wherein the particle is substantially free of silicate salt, wherein the particle is substantially free of carbonate salt and wherein the particle has a pH of 6.0 or less, upon dissolution in de-ionized water at a concentration of 10 wt % and a temperature of 25° C.

2. A process according claim 1, wherein the aqueous mixture has a pH of about 3.5 or less.

3. A process according to claim 1, wherein the particle has a pH of 5.0 or less, upon dissolution in de-ionized water at a concentration of 10 wt % and a temperature of 25° C.

4. A process according to claim 1, wherein the particle has a pH of about 4.2 or less, upon dissolution in de-ionized water at a concentration of 10 wt % and a temperature of 20° C.

5. A process according to claim 1, wherein the particle has a pH of about 3.5 or less, upon dissolution in de-ionized water at a concentration of 10 wt % and a temperature of 20° C.

6. A process according to claim 1, wherein the monomeric organic carboxylic acid is a monomeric organic polycarboxylic acid.

7. A process according to claim 6, wherein the monomeric organic polycarboxylic acid is citric acid.

8. A process according to claim 1, wherein the detersive surfactant is alkyl benzene sulphonate.

9. A process according to claim 1, wherein the weight ratio of monomeric organic carboxylic acid to zeolite present in the aqueous mixture is at least about 1.6.

10. A process according to claim 1, wherein the aqueous mixture comprises magnesium sulphate, and wherein the particle comprises magnesium sulphate in amorphous form.

11. A process according to claim 1, wherein the aqueous mixture comprises carboxylate polymer, and wherein the particle comprises carboxylate polymer.

12. A process according to claim 1, wherein the aqueous mixture further comprises magnesium sulphate, polymer, and sodium sulphate, wherein the particle comprises:

(a) from about 12 wt % to about 30 wt % detersive surfactant;

(b) from about 4 wt % to about 10 wt % monomeric organic carboxylic acid;

(c) from about 0.5 wt % to about 3 wt % silica;

(d) from about 2 wt % to about 10 wt % magnesium sulphate;

(e) from about 0.5 wt % to about 5 wt % polymer;

(f) from about 35 wt % to about 80 wt % sodium sulphate; and (g) from above 0 wt % to about 6 wt % water.

13. A process according to claim 1, wherein the aqueous mixture further comprises magnesium sulphate, polymer, and sodium sulphate, wherein after the zeolite has reacted with the monomeric organic carboxylic acid, the aqueous mixture comprises:

(a) from about 20 wt % to about 40 wt % water;

(b) from about 7.2 wt % to about 24 wt % detersive surfactant;

(c) from about 2.4 wt % to about 8 wt % monomeric organic carboxylic acid;

(d) from about 0.3 wt % to about 2.4 wt % silica;

(e) from about 1.2 wt % to about 8 wt % magnesium sulphate;

(f) from about 0.3 wt % to about 4 wt % polymer; and (g) from about 21 wt % to about 64 wt % sodium sulphate.

* * * * *